US011214915B2

(12) United States Patent
Collins et al.

(10) Patent No.: US 11,214,915 B2
(45) Date of Patent: Jan. 4, 2022

(54) COLLAR SHAPER AND COMPRESSION SYSTEM

(71) Applicant: Snap Collar, LLC, Washington, DC (US)

(72) Inventors: John Michael Collins, Washington, DC (US); Michael John Sullivan, Washington, DC (US)

(73) Assignee: Snap Collar, LLC, Washington, DC (US)

( * ) Notice: Subject to any disclaimer, the term of this patent is extended or adjusted under 35 U.S.C. 154(b) by 0 days.

(21) Appl. No.: 16/521,604

(22) Filed: Jul. 25, 2019

(65) Prior Publication Data

US 2021/0025107 A1 Jan. 28, 2021

(51) Int. Cl.
*D06F 71/22* (2006.01)

(52) U.S. Cl.
CPC ..... *D06F 71/22* (2013.01)

(58) Field of Classification Search
CPC ..... D06C 15/00; D06C 15/10; D06F 71/22; D06F 71/18; D06F 59/00; D06F 59/02; A41B 3/00; A41B 3/06; A41B 3/08; A41B 3/18; A41B 5/00; A47G 25/72
USPC ... 223/52.1, 52.2, 52.3, 52.4, 52.5, 52.6, 83, 223/84; 2/60, 129, 132, 142
See application file for complete search history.

(56) References Cited

U.S. PATENT DOCUMENTS

| | | | | |
|---|---|---|---|---|
| 5,553,410 | A | 9/1996 | Derby | |
| 6,240,559 | B1 | 6/2001 | Cares | |
| 6,269,988 | B1 | 8/2001 | Kool | |
| 8,292,114 | B1 * | 10/2012 | Tabele, Jr. | B65F 1/06 220/495.08 |
| 8,973,165 | B1 | 3/2015 | Zaki | |
| 9,187,854 | B2 | 11/2015 | Mota | |
| 9,752,276 | B2 | 9/2017 | Ye et al. | |
| 2013/0036623 | A1 * | 2/2013 | Kraetsch | D06F 59/02 34/381 |
| 2018/0263297 | A1 * | 9/2018 | Gilde | A41B 3/18 |

* cited by examiner

*Primary Examiner* — F Griffin Hall
(74) *Attorney, Agent, or Firm* — Howard University School of Law

(57) ABSTRACT

A collar compression system is configured to press a shirt collar and restore the collar to its store-bought form. The open triangle press body is placed on the inside of the shirt collar. The open triangle press body can be made of plastic to hold the shape of the collar. The three separate press members are also made of plastic. One press member is located on the left, right and rear side of the open triangle body. In this embodiment, the living hinge may be made of plastic, metal, or a combination of both. The living hinges connect the press members to the open triangle press body. In one operation, the open triangle press body can be placed on the inside of the collar and the three press members may be placed over the top of the collar to compress the collar, which shapes the collar to its pressed form.

6 Claims, 10 Drawing Sheets

COLLAR SHAPER AND COMPRESSION SYSTEM

FIELD

The aspects of the present disclosure relates generally to compression systems for finishing garments for wearing by a body. More specifically, the present disclosure relates to systems, methods and apparatuses for use in press finishing of portions of a garment, such as the collar of a shirt.

BACKGROUND

There is an issue with trying to keep shirt collars from being wrinkled. This problem does not appear to apply to shirts that are going to the dry cleaners because those shirts will be pressed for customers. However, some shirts are laundered at home or other locations. Ironing a collar is difficult and sometime ineffective. One of the more difficult operations in the laundering of dress shirts and other such garments comprising a collar is the pressing and preserving of the garment's collar. Maintaining the look of a pressed collar after laundering a dress shirt poses a challenge to the average individual. After being laundered and specifically after removal from a conventional clothes dryer, the collar is often deformed in shape and/or texture. To regain the pressed collar appearance, an individual may attempt to use a hot clothes iron to press and reshape the collar. Due to the curved nature of collars, this process often requires a significant amount of time, effort, and even frustration.

In order to avoid the time and effort required for pressing and reshaping the collars on garments, individuals may resort to using a laundry service. Typically, the laundry service uses a dedicated pressing machine to press these collars after washing and prior to pressing of the remaining portions of the garment resulting in a pressed collar appearance. Unfortunately, laundry services tend not only to be relatively expensive, but they also require a relatively large amount of time from the garment's owner due to the laundering process and the required travel to drop off and pick up the garment.

SUMMARY

In light of the foregoing background, the following presents a simplified summary of the present disclosure in order to provide a basic understanding of some aspects of the disclosure. This summary is not an extensive overview of the disclosure. It is not intended to identify key or critical elements of the disclosure or to delineate the scope of the disclosure. The following summary merely presents some concepts of the disclosure in a simplified form as a prelude to the more detailed description provided below.

Aspects of the present disclosure include systems, apparatus, and methods of a collar shaper and compression system that is employed to press a shirt collar. In one aspect, the collar shaper and system may be comprised of a main press body attached to at least one press member by a hinge.

In other aspects, the collar shaper and compression system may be comprised of a main press body attached to at least one press member by a living hinge. In yet other aspects, the collar shaper and compression system may be comprised of main press body attached to a plurality of press members by living hinges.

In yet other aspects, the collar shaper and compression system may be comprised of a main press body attached to three press members by living hinges. In yet other aspects, an articulated collar shaper and compression system may be comprised of a press body configured to be inserted into a collar of a shirt or collared garment. At least one press member may be pivotally attached to the press body by a living hinge. At least one compression clip may be configured to engage the at least one press member.

In yet other aspects, a collar press system has least one press member that may include a planar section and an arcuate section. In yet another aspect, a collar press system has the least one press member that may include a planar section interposed between two arcuate sections. In yet another aspect, a collar press system may include an upper portion of the least one press member includes a curved portion from a proximal end to a distal end.

In yet another aspect, an articulated collar press system may include a body configured to be inserted into a collar of a shirt. A press member can be pivotally attached to the body by a living hinge and at least one biasing member can be configured to resiliently engage the press member. In yet other aspects, the press body may be placed on the inside of the neck facing surface of the shirt collar and the three press members, then close down to compress the collar. One method may be used after wearing the shirt or after a home laundry process to keep the collar shape.

BRIEF DESCRIPTION OF THE DRAWINGS

The foregoing summary as well as the following detailed description of the invention, considered in conjunction with the accompanying drawings, provides a better understanding of the disclosure, in which like reference numbers refer to like elements, and wherein.

DETAILED DESCRIPTION

Figure 1:
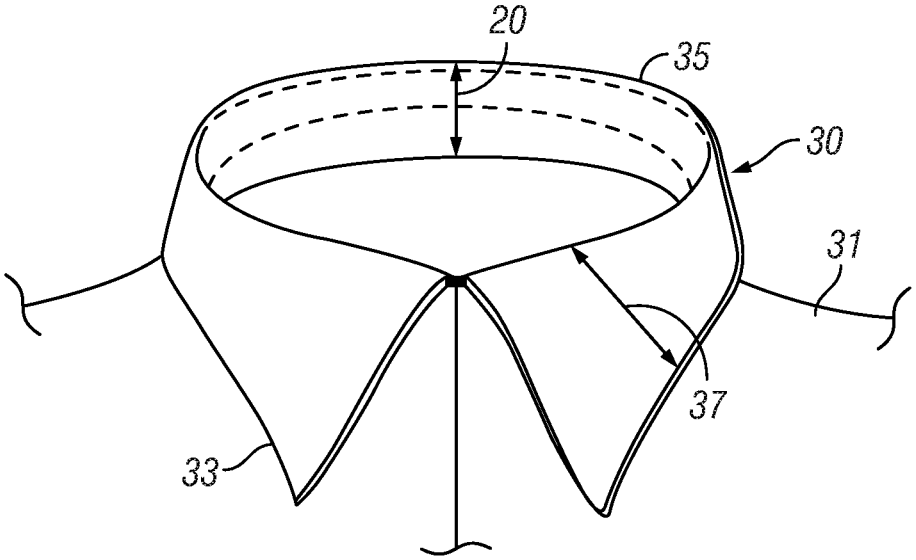
FIG. 1 (PRIOR ART)
FIG. 1 is a front elevation of the upper portion of a conventional dress shirt collar being shown in a closed position.

The accompanying drawings, which form a part hereof, show examples of the disclosure. It is to be understood that the examples shown in the drawings and/or discussed herein are non-exclusive and that there are other examples of how the disclosure may be practiced.

Figure 2:
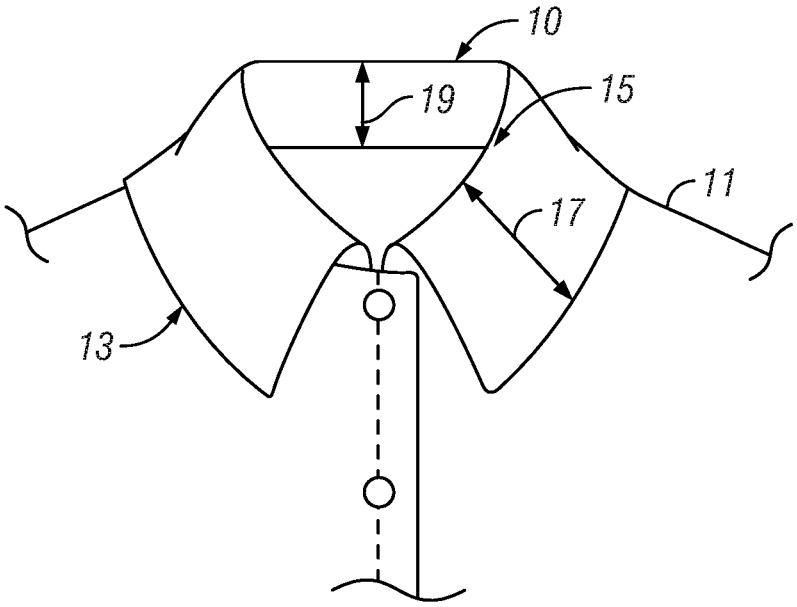
FIG. 2 (PRIOR ART)
FIG. 2 is a similar view showing the conventional sport shirt collar being shown in a closed position.

Referring to the FIGS. 1 and 2, the numerals 10, 30 designate conventional a shirt collar or garment collar which is shown as attached to the shirt 11, 31 in which the lower portion of the shirt being shown broken away. Shirt collar 10 pertains to a sport shirt collar and shirt collar 30 pertains to a dress shirt collar. In the present disclosure, systems and methods are described for a collar shaper and compression system 100 that is employed to press a shirt collar (such as, shirt collar 10, 30) to restore it to three-dimensional closed form to keep the shirt collar crisp and unwrinkled.

In the present disclosure, FIGS. 3 through 11 illustrate an articulated collar shaper and compression system 100. In accordance with the present disclosure, the collar shaper and compression system 100 may include a main press collar body 102 being pivotally connected to one to three articulated press members 110, 112, 114. In this way, the collar shaper and compression system 100 provides an efficient way to press the collar of a shirt by reducing a significant amount of time and effort in order to press the collar of a shirt. In one construction, the articulated press members 110, 112, 114 are connected to the main collar press body 102 pivotal hinged system. In yet another construction, each of the hinges 104, 106, 108 of the press members 110, 112, 114 can be considered a living hinge. The press members 110, 112, 114 are connected at the top edge of the press body 102 and extend downward to engage and compress a collar 10, 30 of a shirt 11, 31, such as the length of the fall line 17, 37 shown in FIGS. 1 and 2. Furthermore, the system 100 operates on a collar 10, 30 with different style edges or style lines 13, 33.

In one construction, the press members 110, 112, 114 and living hinges 104, 106, 108 are integrally molded with the main press body 102 to form a single unit or unitary construction. The plastic material (such as polypropylene) for the main press body 102, press members 110, 112, 114 can be lightweight, and may have a generally smooth surface. The main press body 102, press members 110, 112, 114 are manufactured or formed in a process such as, injection molding or 3D printing. Injection molding is one manufacturing process used to form the above mentioned components. It should be noted that collar shaper and compression system 100 could also be constructed using 3-D printing technology. The collar shaper and compression system 100 would be defined in a digital 3D computer model. Then a designated 3-D printer processes the digital model to build-up plastic layers of the object (collar shaper and compression system 100) to construct the final product. This build-up process is known in the technology area as additive manufacturing.

In one construction, the collar shaper and compression system 100 may be comprised of a molded construction attached to three press members 110, 112, 114 by living hinges 104, 106, 108. The press body 102 may be the height of the collar stand 19 shown in FIG. 2 or height of collar band 20 from the neck line shown in FIG. 1. In one method of use, the collar shaper and compression system 100 is placed on the inside of a shirt collar, such as shirt collar 10, 30 (See FIGS. 1 and 2). The main press body 102 is inserted inside of a shirt collar 10, 30 "neck facing side" and the three press members 110, 112, 114 are then pivoted downward over the collar roll line 15 or collar edge line 35 (see FIGS. 1 and 2) to compress the collar 10, 30 in its closed form. This method may be used after wearing the shirt or after the laundry process to keep the collar in its store-bought form. A compression clip 120 may be engaged on the outer surface of the living hinges 104, 106, 108 supported by "neck facing side" of the main press body 102. When not engaged, a cable 122 is attached to living hinge 106 to retain the clip 120. Nevertheless, the cable 122 could be attached to other parts of the press body 102 or press members 110, 112, 114. Further to provide a "snap fit" compression the press members 110, 112, 114, may have a hole 170 to fit therein (See FIGS. 4 and 11). The clip 120 may be constructed of a resilient material (such as plastic material) to provide a compressive bias when engaged on an abutting surface.

Figure 3:
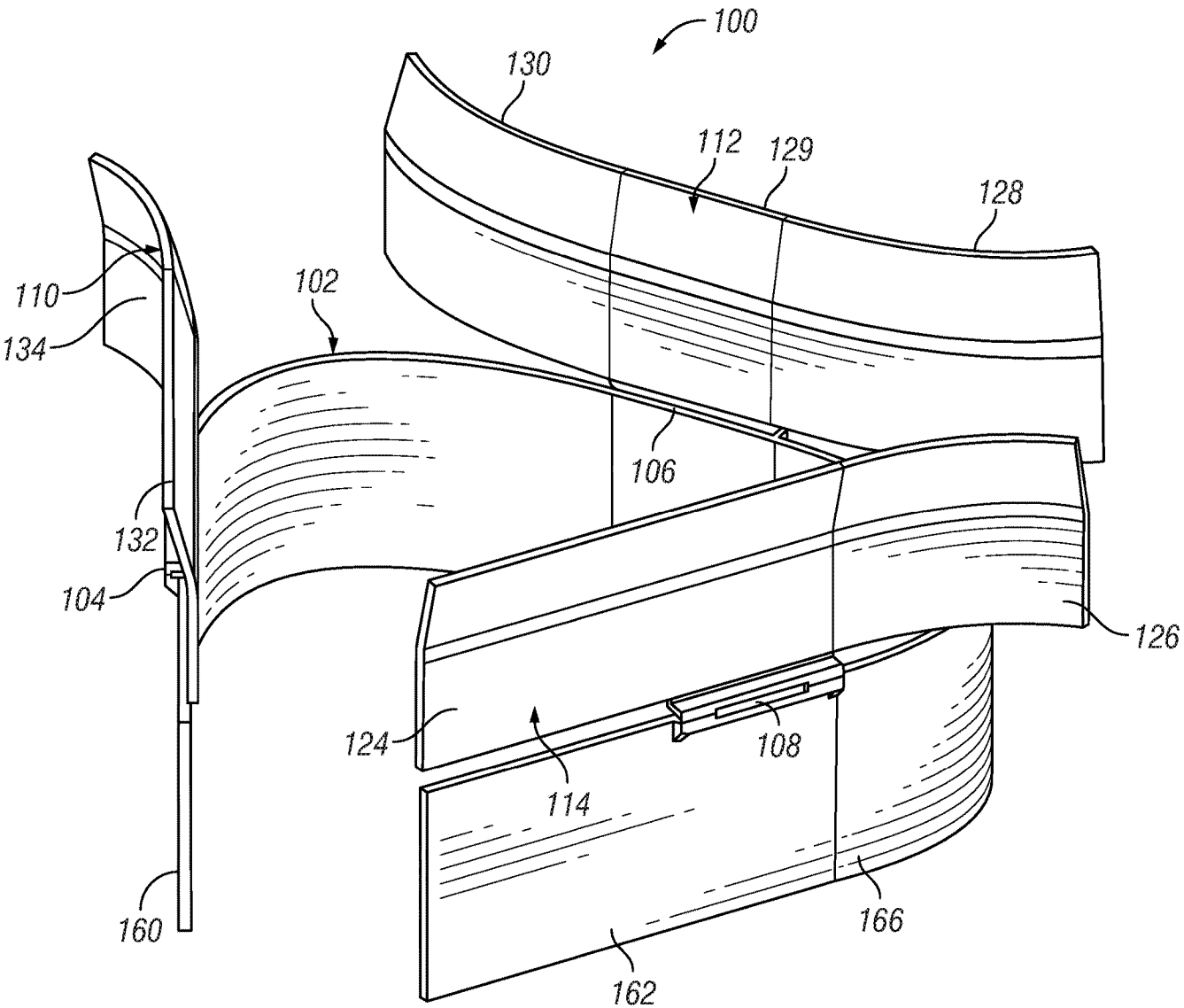
FIG. 3 depicts a top-right front perspective view of a collar shaper and compression system illustrating a construction in the open position in accordance with the present disclosure.
Figure 4:
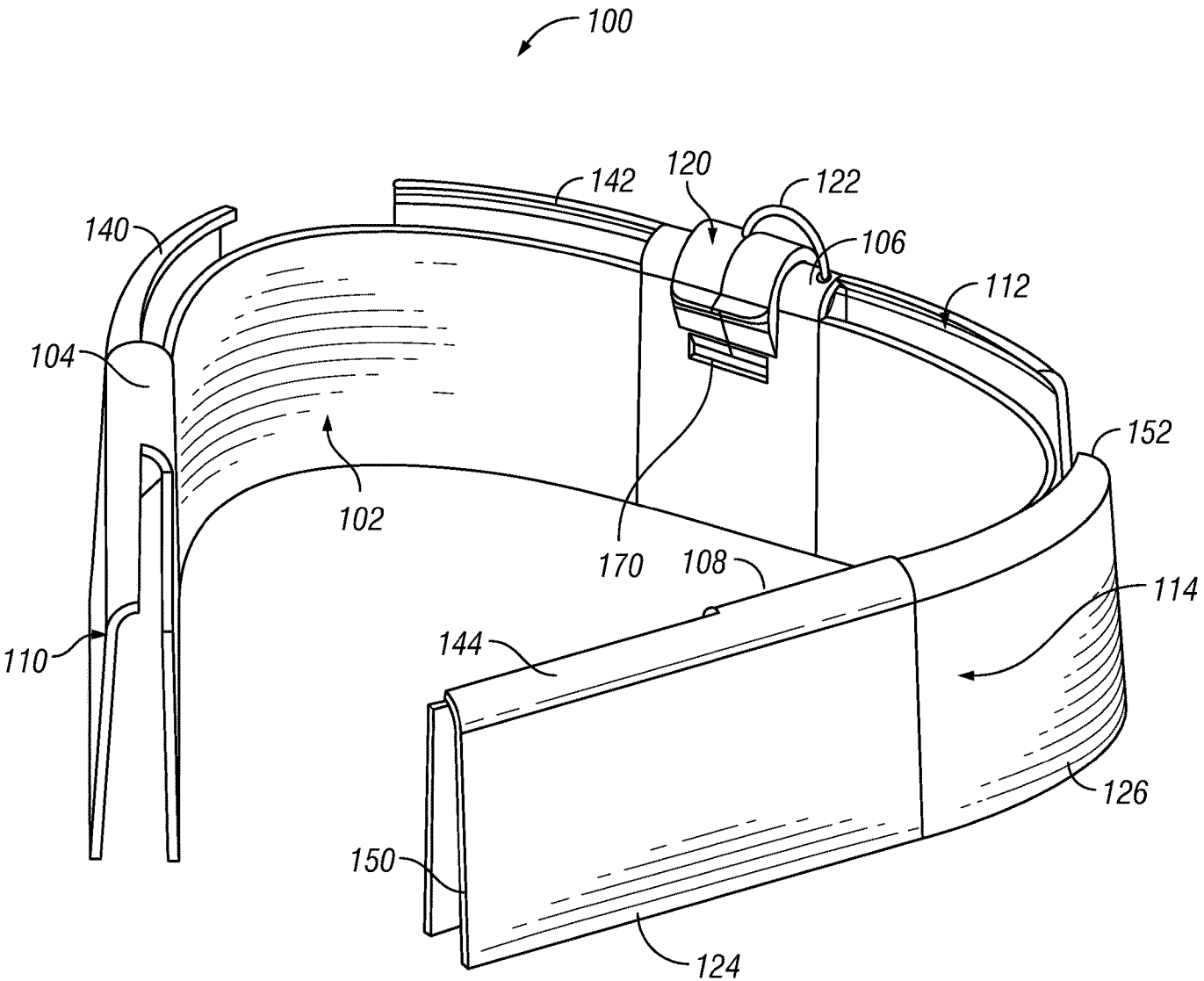
FIG. 4 depicts a top-right front perspective view of the collar shaper and compression system shown FIG. 3 in an engaged position in accordance with the present disclosure.
Figure 5:
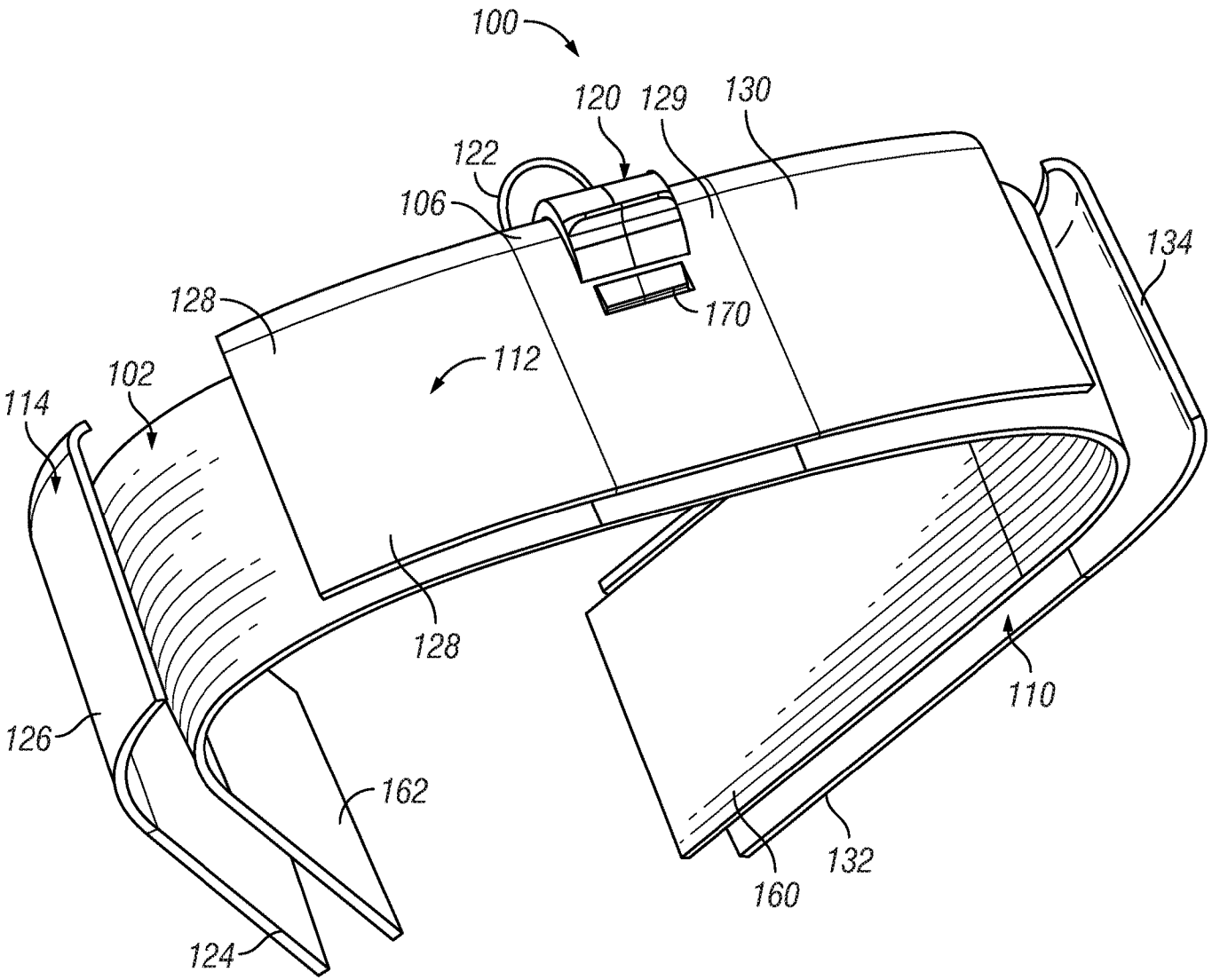
FIG. 5 depicts a bottom-right rear perspective view of the collar shaper and compression system in an engaged position in accordance with the present disclosure.
Figure 6:
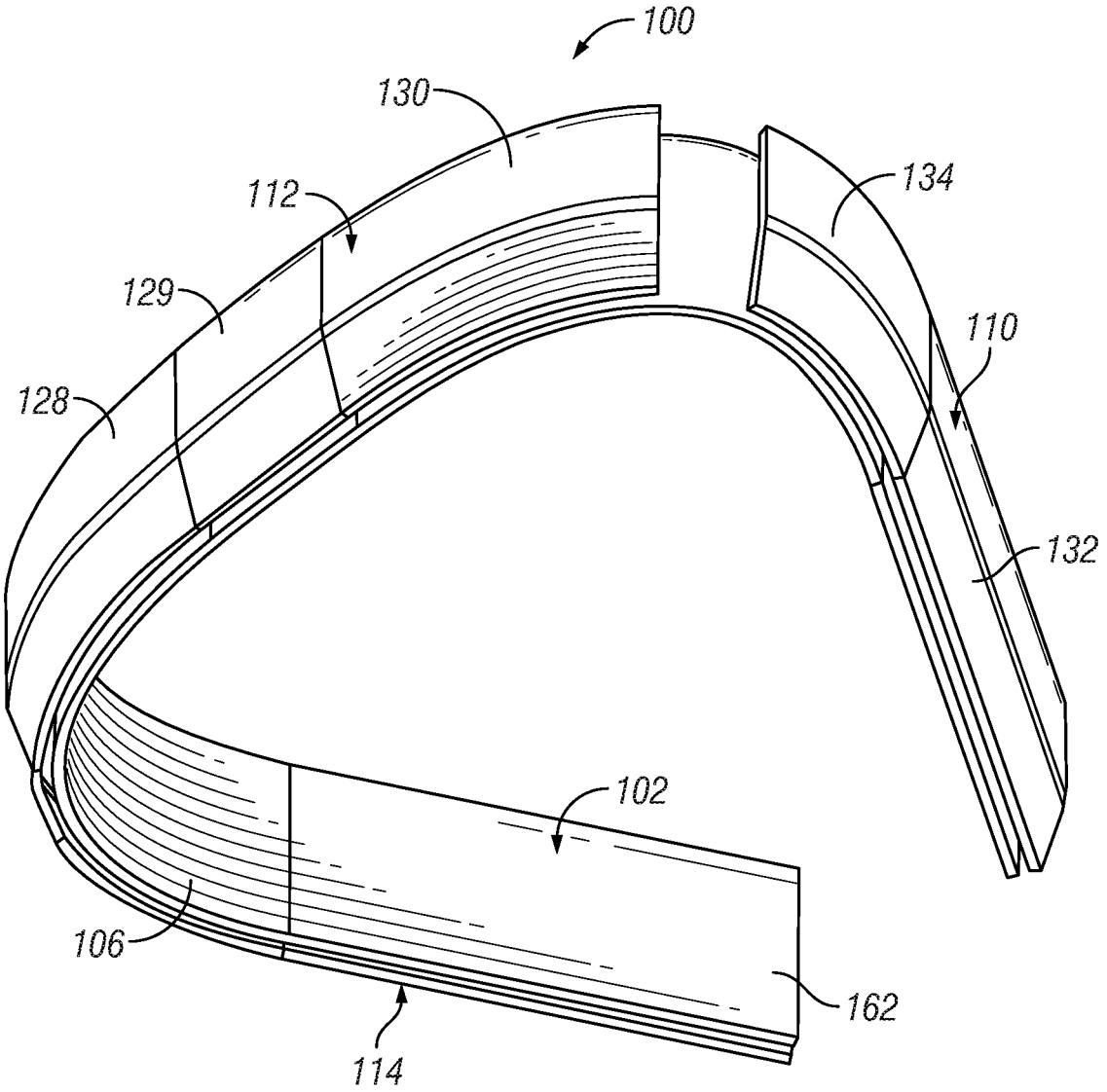
FIG. 6 depicts a bottom-left rear perspective view of the collar shaper and compression system in an engaged position in accordance with the present disclosure.

Referring to FIGS. 3 and 6, in one construction of the present disclosure, a collar shaper and compression system 100 may include an open triangle-like press body 102 connected to three press members 110, 112, 114 by living hinges 104, 106, 108. Right side press member 114 located on the right side of the system 100 is connected to the press body 102 by the living hinge 108 used to compress the collar on the right side. In one construction, the press member 114 has a front straight/planar section 124 and a rear arcuate section 126 to provide enhanced shaping and uniform compression pressure of the shirt collar.

Left side press member 110 being located on the left side of the system 100 is connected to the press body 102 by the living hinge 104 and is used to compress the collar on the left side. In one construction, the press member 110 has a front straight/planar section 132 and a rear arcuate section 134 to provide enhanced shaping and uniform compression pressure of the shirt collar. Press member 112 being located on the rear side of the system 100 is connected to the press body 102 by the living hinge 106 and is used to compress the collar on the rear side. In one construction, the rear press member 112 has a straight/planar section 129 interposed between two arcuate sections 130, 128 to provide enhanced shaping and uniform compression of the shirt collar. In another construction, the upper portion of the press members 110, 112, 114 have an inward curvilinear portion 140, 142, 144 to better preserve the roll line 15 or upper edge of the collar 10. In one example shown in FIG. 4, the curved upper portion 144 extends from a proximal edge 150 to the distal edge 152 of the press member 114.

Figure 7:
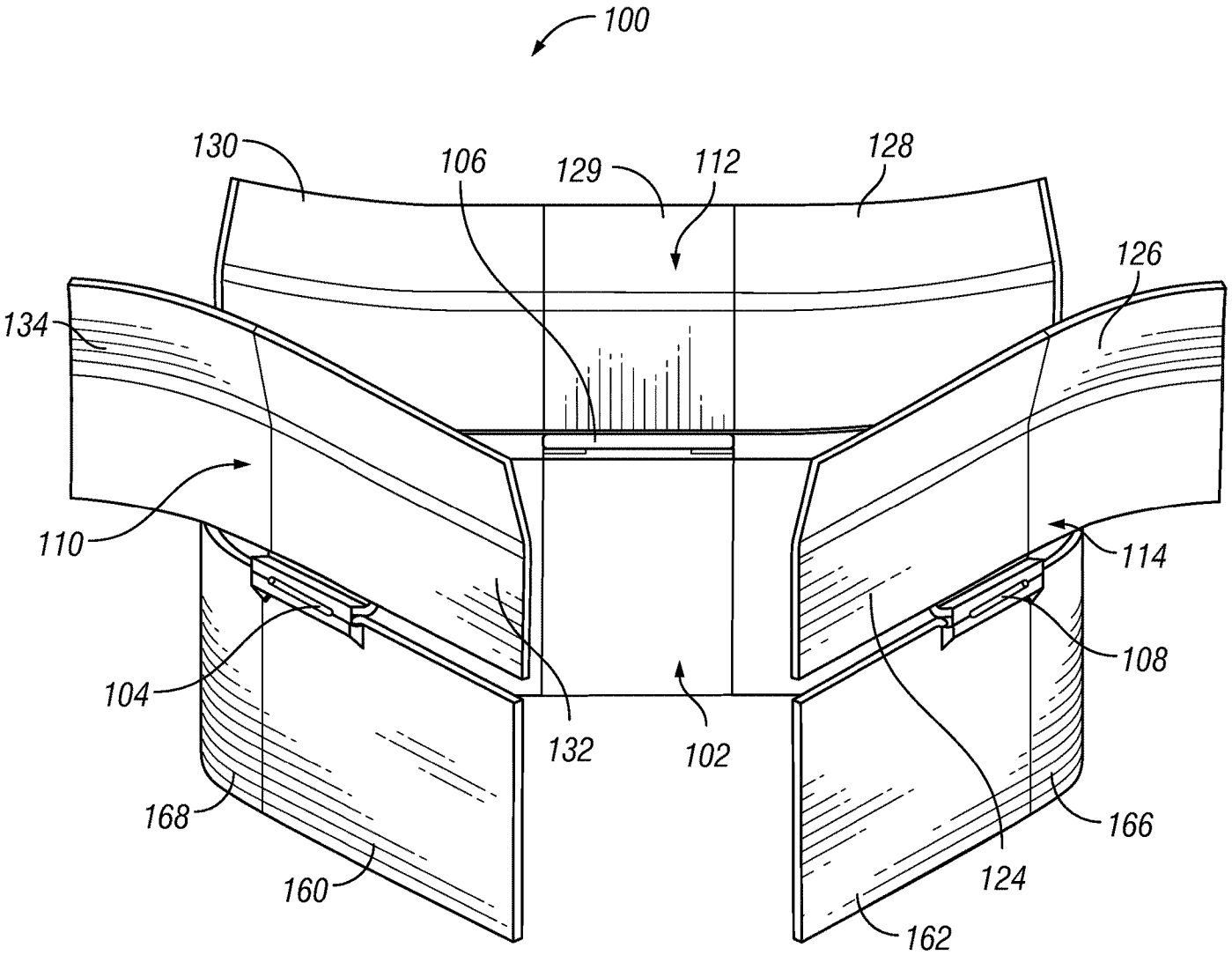
FIG. 7 depicts a front perspective view of the collar shaper and compression system in an open position in accordance with the present disclosure.
Figure 8:
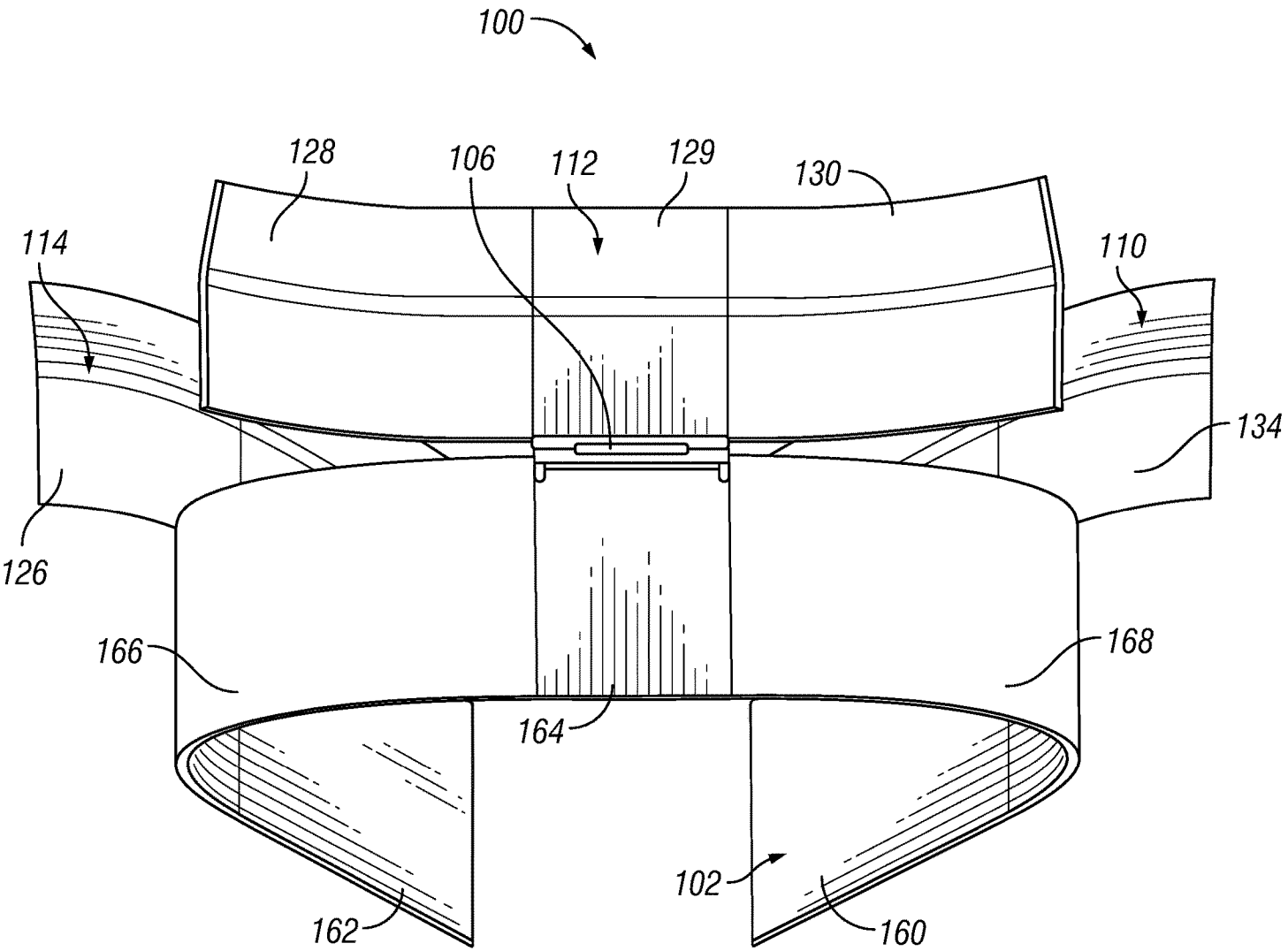
FIG. 8 depicts a rear perspective view opposite of FIG. 7 of the collar shaper and compression system in an open position in accordance with the present disclosure.
Figure 9:
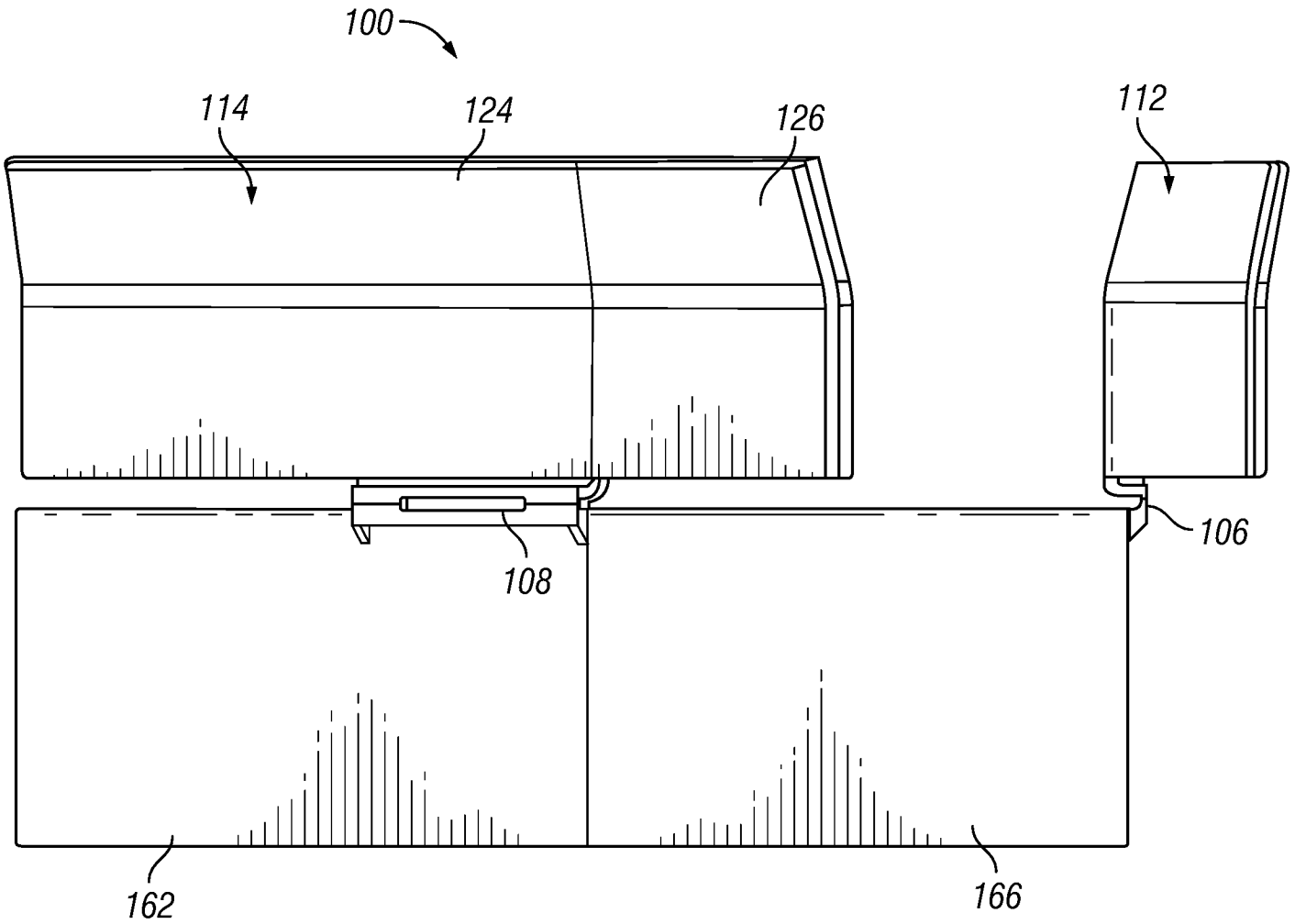
FIG. 9 depicts a right side view of the collar shaper and compression system in the open position in accordance with the present disclosure.
Figure 10:
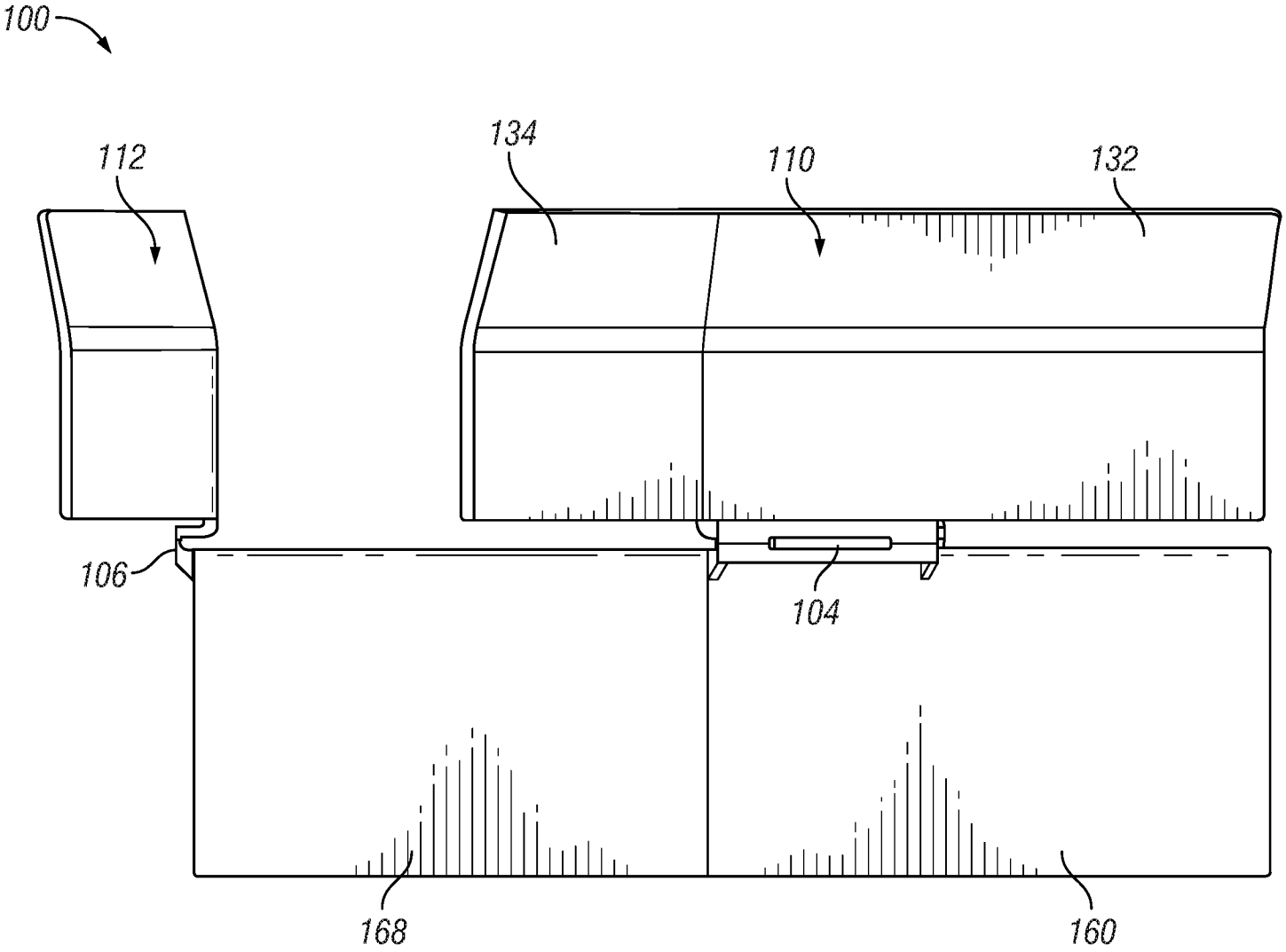
FIG. 10 depicts a left side view of the collar shaper and compression system in the open position in accordance with the present disclosure.
Figure 11:
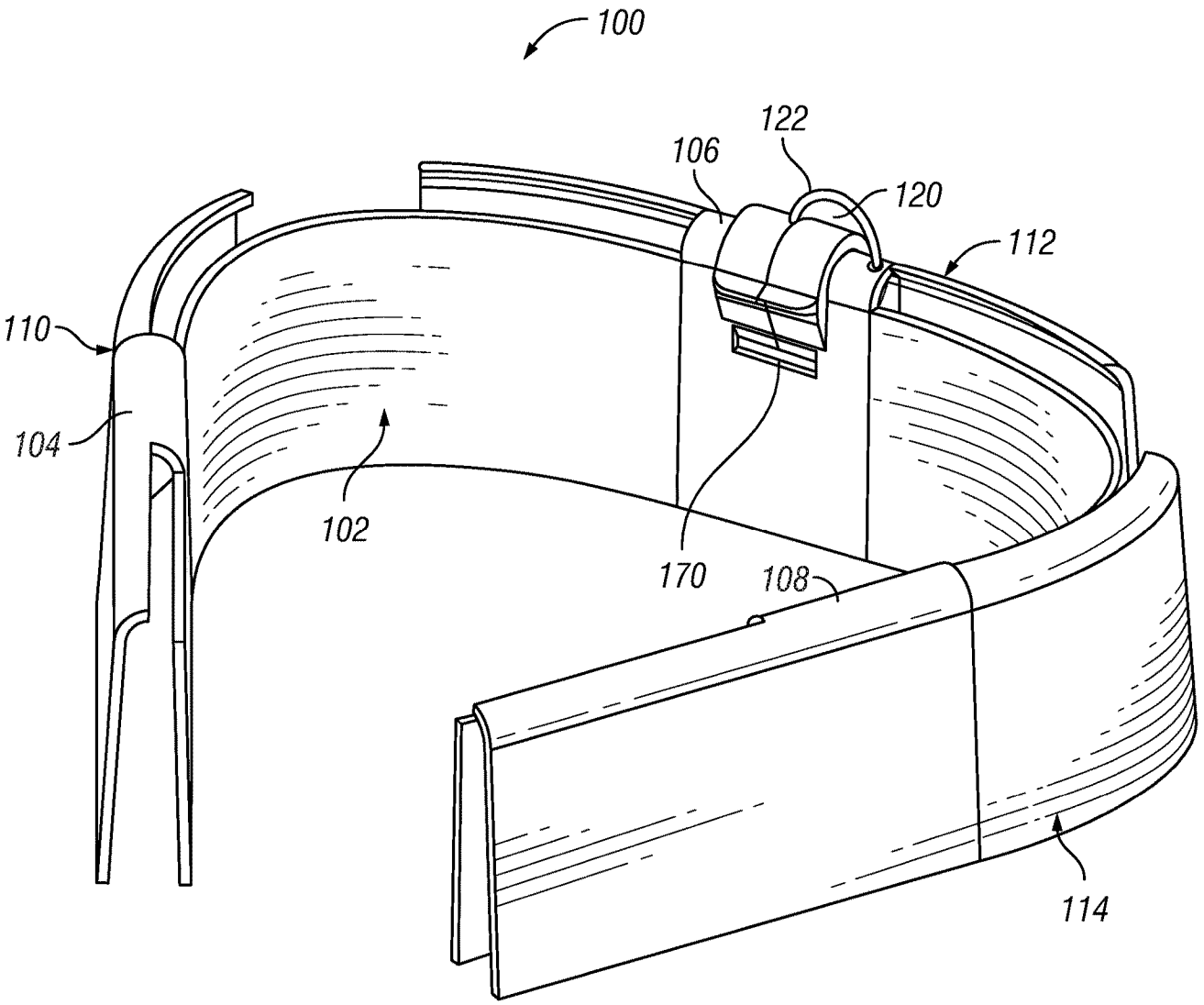
FIG. 11 depicts a bottom-right rear perspective view of the collar shaper and compression system in an engaged position in accordance with the present disclosure.

In one construction, the open triangle-shaped press body 102 is placed on the inside of the shirt collar. Referring to FIGS. 3, 7, and 8, open triangle-shaped press body 102 has front straight/planar sections 160, 162 and curved sections 166, 168 and a rear straight/planar section 164. Press member 114 has front straight/planar section 124 and a rear arcuate section 126 which provides complementary shape matching to front straight section 162 and curve section 166 of press body 102 which helps enhance shaping performance and uniform compression pressure of the shirt collar. Press member 110 has a front straight section 132 and a rear arcuate section 134 which provides complementary shape matching to front straight section 160 and curve section 168 of press body 102 provide enhanced shaping and uniform compression pressure of the shirt collar. Rear press member 112 has a straight section 129 interposed between two arcuate sections 128, 130 which provide complementary shape matching to rear straight section 164 and curved sections 166, 168 to provide enhanced shaping and uniform compression of the shirt collar.

Press members 110, 112, 114 are located on the left, rear, and right side of the open triangle press body 102. In this embodiment, the living hinge 104, 106, 108 may be made of plastic. The living hinges 104, 106, 108 connect the press members 110, 112, 114 to the open triangle mold body 102. The system 100 operates by the open triangle-shaped press body 102 being placed on the inside of the collar and then closing the three press members 110, 112, 114 on over the top of the collar to compress the collar, which shapes the collar to an unwrinkled arrangement.

The collar shaper and compression system 100 can be used on sport shirts 10 or "polo shirts" and dress shirts 30. Because sport shirts are designed in the expectation that the collar will usually be worn open, the collar band 20 (see FIG. 1), which forms a customary part of the dress shirt construction is omitted so that the collar is attached directly to the shirt body at the neck line. In some constructions, the collar shaper and compression system 100 may be configured to press the collar of a shirt 11, 30 to produce a well pressed collar appearance without the time and expense associated with using a laundry service. In yet some constructions, the collar shaper and compression system 100 may be configured to press the collar of a shirt to produce a well pressed collar appearance without using a conventional clothes dryer.

It should be noted the terms "including" and "comprising" should be interpreted as meaning "including, but not limited to".

In this specification, "a" and "an" and similar phrases are to be interpreted as "at least one" and "one or more." References to "the," "said," and similar phrases should be interpreted as "the at least one", "said at least one", etc. References to "an" embodiment in this disclosure are not necessarily to the same embodiment.

It is the applicant's intent that only claims that include the express language "means for" or "step for" be interpreted under 35 U.S.C. section 112. Claims that do not expressly include the phrase "means for" or "step for" are not to be interpreted under 35 U.S.C. section 112.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

Collar shaper and system 100 of the present disclosure has a configuration in which the components can be configured operate together or separately. All U.S. patents referred to in this application are fully incorporated by reference for all purposes. While the system and methods have been described with reference to exemplary embodiments and constructions, it will be understood by those of ordinary skill in the art that various changes may be made and equivalents may be substituted for elements thereof without departing from the scope of the disclosure. In addition, many modifications may be made to adapt a particular situation or material to the teachings of the invention without departing from the scope thereof. For example, it is to be understood that the present technology contemplates that, to the extent possible, one or more features of any implementation can be combined with one or more features of any other implementation. Therefore, it is intended that the invention not be limited to the particular embodiments disclosed, but that the invention will include all embodiments falling within the scope of the appended claims.

The invention claimed is:

1. An articulated collar press system, comprising:

a collar body configured to be inserted over a collar band and a collar leaf of a shirt;

a right-side press member, a rear press member, and a left-side press member being pivotally attached to the collar body, each of the press members being attached by a living hinge respectively;

a compression clip being configured to resiliently engage the rear press member;

a cable having opposing distal ends, the first distal end of the cable being connected to the compression clip and the second distal end of the cable being connected to the rear press member; and wherein the collar body, the right-side press member, the rear press member, and the left-side press member, and the living hinges are of a molded unitary construction.

2. The articulated collar press system according to claim 1, wherein an upper portion of each of the press members includes a curved portion from a proximal edge to a distal edge.

3. The articulated collar press system according to claim 1, wherein the rear press member includes a straight section interposed between two arcuate sections; wherein the right-side press member, and the left-side press member each includes a straight section extending from an arcuate section.

4. The articulated collar press system according to claim 3, wherein each of the right-side press member, the rear press member, and the left-side press member members include an upper curved portion from a proximal end to a distal end.

5. The articulated collar press system according to claim 4, wherein each of the straight sections and arcuate sections are bended inward along a longitudinal axis extending across distal free edges of the right-side press member, and the left-side press member, respectively.

6. The articulated collar press system according to claim 4, wherein the collar body further comprises an open triangular shape.

* * * * *